United States Patent [19]

Tisdale

[11] 4,275,780

[45] Jun. 30, 1981

[54] GRAIN AUGER HOPPER

[76] Inventor: Bert B. Tisdale, 4643 - 197th St., Langley, B.C., Canada

[21] Appl. No.: 128,888

[22] Filed: Mar. 10, 1980

[51] Int. Cl.[3] ..... B65D 79/00; B65G 65/34

[52] U.S. Cl. ..... 150/52 R; 141/316; 222/107

[58] Field of Search ..... 150/52 R, 1; 222/105, 222/107, 92, 94; 198/616

[56] References Cited

U.S. PATENT DOCUMENTS

| | | | |
|---|---|---|---|
| 951,156 | 3/1910 | Taylor | 141/390 |
| 3,070,262 | 12/1962 | Battolfron | 222/107 |
| 3,681,872 | 8/1972 | Leitch | 150/52 R |
| 3,822,524 | 7/1974 | Jerpbak | 141/390 |
| 4,200,127 | 4/1980 | Dunleavy | 150/52 R |
| 4,206,795 | 6/1980 | Regan | 150/52R |

*Primary Examiner*—Herbert F. Ross

*Attorney, Agent, or Firm*—Quaintance, Murphy & Richardson

[57] ABSTRACT

An improved auger hopper includes a tarpaulin with a centrally positioned, rigid receptacle secured thereto by a retaining ring. The hopper also includes a cover which fits over the receptacle for both enclosing the tarpaulin within the receptacle for storage and for stacking. Preferably, the receptacle is in the form of a circular shallow pan. When in use, the tarpaulin is spread out on the ground and grain is dumped thereupon prior to lifting the grain up into an adjacent silo with an auger. This prevents the grain from being contaminated by dirt and ground moisture. The tarpaulin includes grommets adjacent the periphery thereof so that the tarpaulin may be wrapped and fastened about a pile of grain to store the grain temporarily when the silo is full.

8 Claims, 6 Drawing Figures

GRAIN AUGER HOPPER

BACKGROUND OF THE INVENTION

1. Field of the Invention

This invention relates to grain auger hoppers, and more particularly, this invention relates to grain auger hoppers which utilize a tarpaulin with a receptacle.

2. Problem and Prior Art Solution

A difficulty experienced by wheat farmers is contamination of grain which occurs when grain is dumped on the ground prior to being transmitted to a storage facility such as a silo. By dumping the grain on the ground a percentage of the grain is spoiled through contamination with dirt and other debris. It has been a general practice to gather the residue of a pile of grain together using shovels or other implements so that all the grain from a load of grain can be transported to a silo. This is a time consuming as well as unsanitary approach to a problem of salvaging as much grain from a load's residue as possible.

In addition, it's frequently necessary to store grain on the ground when silo facilities are full. In the past, this temporary storage was accomplished by shoveling or dumping the excess grain into wooden bins. However, when in wooden bins, the grain is frequently exposed to moisture and is vulnerable to rodent attack.

The prior art includes U.S. Pat. No. 3,070,262 which discloses a grain auger hopper having a tarpaulin with a cup disposed at the center thereof. However, in this patent, the structure is not conducive to stacking for shipment or storage when the tarpaulin is folded up and no provisions are made for using the tarpaulin as a storage device in and of itself. Furthermore, the structure is relatively complex and not easy to assesmble from component parts.

In view of the aforementioned problems and prior art approaches to those problems a new and improved tarpaulin type, grain auger hopper is needed.

SUMMARY OF THE INVENTION

It is a feature of the instant invention to provide a new and improved grain auger hopper of the tarpaulin type wherein the tarpaulin is readily stored and stacked within a receptacle which is an intergral part of the hopper. Moreover, it is a feature of the instant invention to provide a grain auger hopper of the tarpaulin type wherein the hopper may be conveniently used for temporary grain storage.

In view of these features and other features, the instant invention contemplates a grain auger hopper of the tarpaulin type which includes a tarpaulin having a receptacle secured thereto wherein the receptacle includes means for conveniently stacking the hopper with the tarpaulin stored within the receptacle. In addition, the instant invention contemplates a grain storage hopper of the tarpaulin type wherein the tarpaulin includes means for gathering the edges thereof together to form an enclosure for temporarily storing grain.

DESCRIPTION OF THE PREFERRED EMBODIMENT

Figure 1:
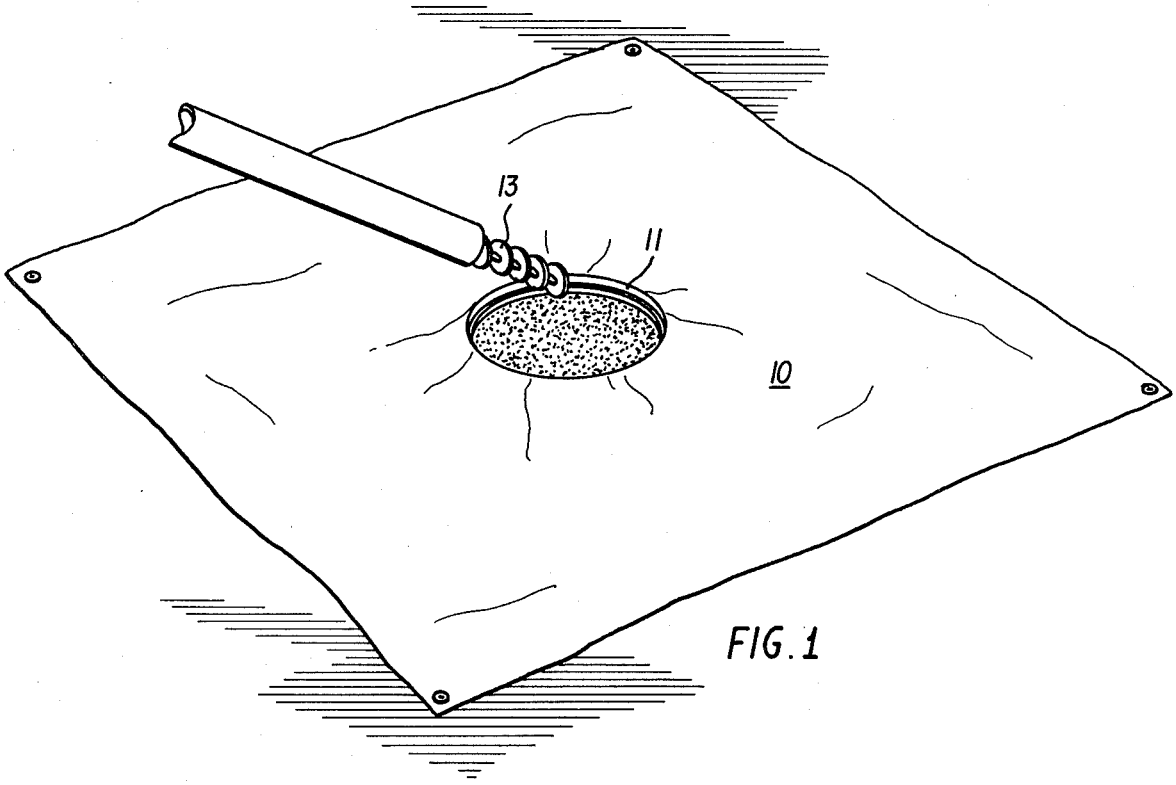
FIG. 1 is a perspective view of the grain auger hopper of the instant invention showing a tarpaulin used therewith spread out on the ground and a residual portion of grain gathered within a receptacle disposed in the center of the tarpaulin.

Referring now to FIG. 1 where the auger grain hopper is shown open and ready for use, the hopper includes a tarpaulin 10 and a centrally positioned receptacle, designed generally by the numeral 11. The tarpaulin 10 is in the form of a square approximately twelve feet on a side and having an area of approximately 140–150 square feet, while the receptacle 11 is in the form of a relatively shallow pan approximately thirty-two inches in diameter and five inches deep. The hopper is simply placed on the ground adjacent to a silo (so that an auger 13 may lift grain dumped on the tarpaulin 10 to the side). Since the receptacle 11 is relatively shallow, it is not necessary to dig a pit for receiving the receptacle and the receptacle merely rests on the existing ground surface. In addition, most of the residual grain left on the tarpaulin 10 which is not piled high enough to be lifted by the auger 13 can be easily shifted into the receptacle by simply lifting the sides of the tarpaulin and perhaps shaking the sides a bit so that the grain slides down into the receptacle. The receptacle is deep enough to permit augering of most of the residual grain.

The tarpaulin 10 includes grommets 15 disposed at the corners thereof so that the hopper is to be used for storage, the tarpaulin can be gathered about a pile of grain to temporarily protect the grain from the weather or rodent attack.

Figure 4:
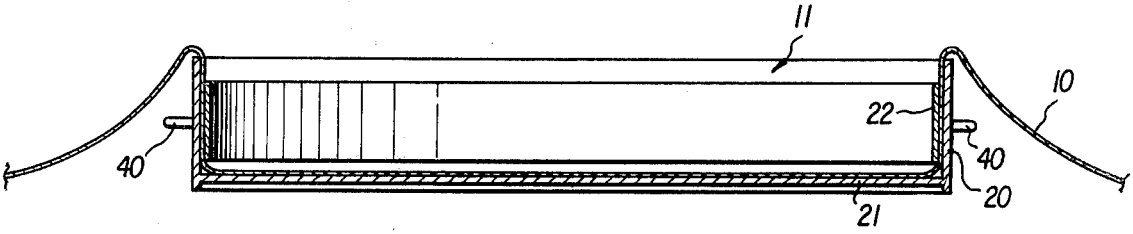
FIG. 4 is a cross-section through one hopper which the tarpaulin spread showing how the receptacle is secured to the tarpaulin with a retaining ring.

As is seen in FIG. 4, the receptacle 11 includes a circular side wall 20 and a floor 21. In order to secure the tarpaulin 10 within the space defined by wall 20 and floor 21, a lock ring 22 is utilized. The lock ring 22 has a diameter slightly smaller than the inner diameter of the wall 20 so as to define a space between the ring and the wall for receiving the tarpaulin 10. During assembly, the tarpaulin 10 is merely rested on top of the receptacle 11 and the lock ring 22 inserted into the receptacle to retain the tarpaulin between the ring and the inner surface of wall 20 by force fit while holding the tarpaulin against the floor 21 of the receptacle. Rapid economical assembly of the hopper is provided by having the geometry of the ring 22 correspond to the geometry of the wall 20.

Figure 2:
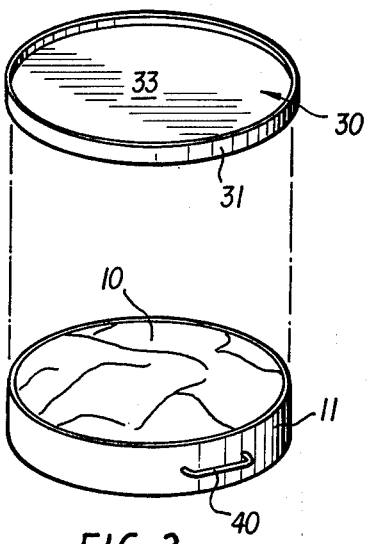
FIG. 2 is a perspective view of a single hopper with the tarpaulin folded up and stored in the receptacle and a lid positioned for placement over the receptacle.
Figure 3:
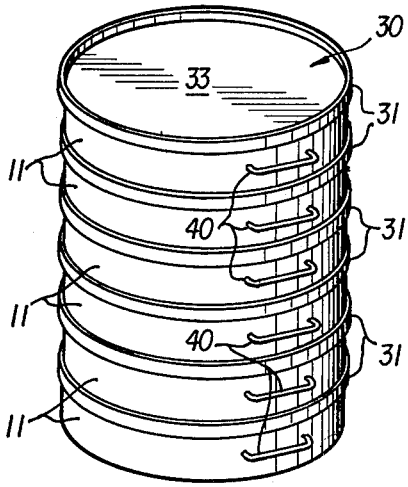
FIG. 3 is a perspective view showing several hoppers stacked.
Figure 5:
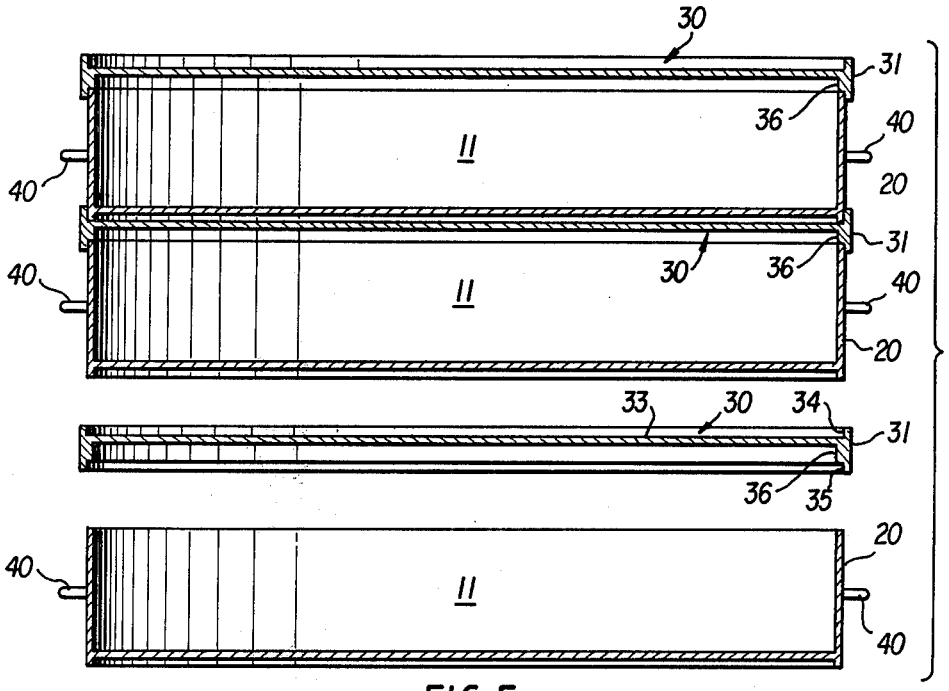
FIG. 5 is a cross-section through three hoppers in which the receptacles are closed by lids and stacked, showing how the lids nest with an adjacent receptacle for storage.

Referring now to FIGS. 2, 3, and 5, a lid designated generally by the numeral 30, having a depending rim 31 is provided for closing the receptacle 11 with the tarpaulin inside in order to store and ship the hopper in a convenient form. As is seen in FIG. 3, the hoppers stack on top of one another for shipment and storage. Stacking is facilitated by having the covering portion 33 of the lid 30 disposed slightly beneath the top surface of the rim 31 so as to provide a shoulder 34 which has an inside diameter equal to the outside diameter of the wall 20 of the receptacle. One receptacle can thereby seat stably within another because the geometry defined by shoulder 34 corresponds to the geometry of wall 22.

The lid 30 is retained in place on the top of the wall 20 by a shoulder 35 formed interiorally of the rim 31. The shoulder 35 has a width of perhaps one-quarter of an inch and is preferably defined by an interior band 36 which is positioned beneath the top 33 of the lid. The band 36 both helps support the top 33 and carries the weight of additional stacked bands to the circular side walls 20 of each receptacle 11.

Figure 6:
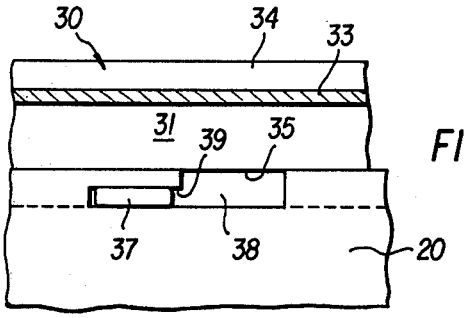
FIG. 6 is an enlarged side view from inside one of the hoppers showing how a lid is secured to a side wall of the hopper.

As is seen in FIG. 6, each lid 30 is secured to a wall 20 by locking lugs 37 which are received in slots 38 in the wall. Only one lug 37 and slot 38 is shown in FIG. 6 but it is to be understood that a plurality of lugs and slots are disposed around the periphery of the lid 30 and wall 20. Locking is accomplished by aligning the lugs 37 with opening of the slot, nesting the lid 30 and wall 20 together and turning the lid to slide the lugs 37 beneath shoulders 39 which define a closed portion of the slot.

To facilitate carrying, each hopper has a pair of handles 40 secured to opposite sides of the wall 20.

By the aforedescribed structure, a new and improved grain auger hopper is provided which is easy and economical to manufacture, convenient to use and easily stacked for shipment and storage. Furthermore, a grain auger hopper is provided which serves conveniently as a temporary storage container.

The foregoing embodiment is merely exemplary of the invention which is to be limited only by the following claims.

What is claimed is:

1. An auger grain hopper comprising:

a tarpaulin having a top surface upon which grain is piled and a bottom surface for covering the ground;

a receptacle positioned on the bottom surface of the tarpaulin;

means for securing the receptacle to the tarpaulin;

a lid for closing the receptacle with the tarpaulin disposed therein when the tarpaulin is not in use; and stabilizing means on the lid for receiving the bottom of another receptacle therein whereby a plurality of receptacles may be stacked with tarpaulins contained therein.

2. The grain auger hopper of claim 1 wherein the means for securing the tarpaulin to the receptacle includes a retaining member having an outside geometry corresponding to the inside geometry of the receptacle wall and being slightly smaller wherein the tarpaulin is retained between the retainer and receptacle wall by a force fit.

3. The auger grain hopper of claim 2 wherein the stabilizing means for stacking the hoppers includes a shoulder around the top of the cover wherein the shoulder has an internal geometry corresponding to the external geometry of the receptacle wherein the receptacles nest within the shoulders when stacking the hoppers.

4. The auger grain hopper of claim 3 wherein the receptacle includes a bottom and wherein the tarpaulin is continuous with a portion covering the bottom of the receptacle.

5. The auger grain hopper of claim 1, 2, 3, or 4 wherein the receptacle is circular in shape, centrally disposed with respect to the tarpaulin, approximately five inches deep and thirty-two inches in diameter and wherein the tarpaulin has an area of approximately 140–150 square feet.

6. The auger grain hopper of claim 1, 2, 3 or 4 wherein the receptacles are circular in configuration and are relatively shallow.

7. The auger grain hopper of claim 1, 2, 3, 4 wherein the tarpaulin includes means adjacent the edges thereof for tying the tarpaulin around a pile of grain to store and protect the grain.

8. The auger grain hopper of claim 1, 2, 3, or 4 wherein the tarpaulin is square.

* * * * *